United States Patent [19]

Stapel et al.

[11] 4,137,858

[45] Feb. 6, 1979

[54] GRIPPER AND BOBBIN ASSEMBLY FOR DOUBLE-LOCK-STITCH SEWING MACHINE

[75] Inventors: Wilhelm Stapel, Bünde; Günter Droste, Leopöldshohe; Klaus-Dieter Seiler, Kirchlengern, all of Fed. Rep. of Germany

[73] Assignee: Dürkoppwerke GmbH, Bielefeld, Fed. Rep. of Germany

[21] Appl. No.: 788,025

[22] Filed: Apr. 15, 1977

[30] Foreign Application Priority Data

Apr. 15, 1976 [DE] Fed. Rep. of Germany ..... 2616738

[51] Int. Cl.[2] ..... D05B 57/14

[52] U.S. Cl. ..... 112/181; 112/229

[58] Field of Search ..... 112/228, 229, 231, 181, 112/197, 201, 202, 254, 255

[56] References Cited

U.S. PATENT DOCUMENTS

| | | | |
|---|---|---|---|
| 1,928,590 | 9/1933 | Grieb | 112/228 |
| 2,332,964 | 10/1943 | Colegrove | 112/228 |
| 2,428,027 | 9/1947 | Ivandick | 112/228 |
| 2,696,794 | 12/1954 | Kirsch | 112/228 X |
| 3,199,480 | 8/1965 | Covert et al. | 112/181 X |
| 3,347,193 | 10/1967 | Perri | 112/228 |
| 3,921,551 | 11/1975 | Gustmann et al. | 112/181 |

FOREIGN PATENT DOCUMENTS

| | | | |
|---|---|---|---|
| 1490911 | 6/1967 | France | 112/181 |
| 583324 | 12/1976 | Switzerland | 112/228 |

*Primary Examiner*—Werner H. Schroeder
*Assistant Examiner*—Moshe I. Cohen
*Attorney, Agent, or Firm*—Karl F. Ross

[57] ABSTRACT

A bobbin and gripper assembly for a double-lock-stitch sewing machine has a stitch plate lying in a horizontal plane and a gripper rotatable in a horizontal plane below the stitch plate and receiving a bobbin housing. The latter is provided with a retaining finger which cooperates with abutments formed on the underside of the stitch plate to retain the bobbin housing against rotation with the gripper. In addition, the bobbin housing is held by a spring member which is effective to yieldably retard the bobbin against rotation in the direction of rotation of the gripper by friction therewith.

6 Claims, 2 Drawing Figures

GRIPPER AND BOBBIN ASSEMBLY FOR DOUBLE-LOCK-STITCH SEWING MACHINE

FIELD OF THE INVENTION

The present invention relates to a double-lock-stitch sewing machine of the type in which a gripper is rotatable in a horizontal plane below the stitch plate and receives the bobbin housing which, in turn, is provided with a retaining finger cooperating with abutments formed on the underside of the stitch plate.

BACKGROUND OF THE INVENTION

In the formation of a double lock stitch, the thread carried by the sewing machine needle through the opening in the stitch plate is engaged below the stitch plate by a gripper which can, in some machines, be of the rotatable type. A double-lock-stitch sewing machine with rotating gripper generally comprises, with the gripper, a bobbin housing from which the bobbin feeds a looper thread or underthread for engagement with the thread carried downwardly by the needle to produce the double lock stitch.

In general, the bobbin housing is provided with a holding device adapted to prevent the bobbin housing from being frictionally entrained by the rotation of the gripper.

Such holding device can comprise a holding finger, on the one hand, and an abutment on the other hand. During each stitch formation in the conventional system, a throughgoing gap is opened between the retaining finger and the abutment to pass the upper thread loop. This gap formation can be effected by the thread itself, in which case, under the effect of thread tension, the bobbin housing is rotated slightly in the sense opposite the gripper rotation sense through a small angle. This results in the gap between the retaining finger and the abutment to clear the upper thread loop.

With rapidly operating industrial sewing machines, however, the force which is effective on the holding device is generally so great that the upper thread tension must be increased to an undesirable extent to bring about the aforementioned gap formation.

In one prior art double-lock-stitch sewing machine (see German patent application No. 14 39 214), the holding device for the bobbing housing comprises a two-part retaining finger with a rigid and a yieldable section. The yieldable portion of the retaining device is formed as a spring rod which is movable in the direction of withdrawal of the needle-thread loop and can be resiliently deformed by the thread to permit the aforementioned throughgoing gap to form.

Since the yieldable mass is small, a passage for the needle-thread loop is achieved without interfering with the formation of clean seam or undesirable increase in the thread tension.

However, the retaining device for the bobbin housing of this prior art teaching is suitable only for a gripper rotatable in a vertical plane and makes use of a two-part retaining finger which is fixed to the fabric-carrying plate and cooperates with abutments on the bobbin housing. Such a retaining device has been found to be unsatisfactory for grippers rotatable in a horizontal plane because of the different thread movements and the inability to mount the retaining finger and abutments in the aforedescribed manner.

OBJECT OF THE INVENTION

It is the object of the present invention to provide a gripper assembly for a double-lock-stitch sewing machine of the type in which the gripper is rotatable in a horizontal plane below the stitch plates, whereby the aforedescribed disadvantages of earlier retaining devices can be avoided and some of the advantages of the system hitherto considered practical only for a gripper rotating in a vertical plane, can be attained.

SUMMARY OF THE INVENTION

This object and others which will become apparent hereinafter are attained, in accordance with the present invention, in a double-lock-stitch sewing machine having a stitch plate and a gripper rotatable in a horizontal plane below the stitch plate and receiving the bobbin housing. The latter is provided, in accordance with prior-art teachings, with a retaining finger which cooperates with abutments on the underside of the stitch plate. According to the present invention, in addition to the aforementioned retaining finger, the bobbin housing is additionally engaged by a spring member, a spring rod or wire which biases the bobbin housing against the friction force tending to entrain it along with the gripper, the spring wire engaging the bobbin housing ahead of the retaining finger in the direction of thread withdrawal. The spring wire is effective, according to the present invention, to form the necessary gap between the retaining finger and the abutment on the underside of the stitch plate to clear the needle-thread loop.

According to a feature of the invention, the spring wire or rod is held at its end remote from the bobbin housing in a clamp and, at its end engaging the bobbin housing, rests against a flank of recess formed on the bobbin housing.

Alternatively, the spring member can be a ball bearing against the bobbin housing in a horizontal plane, i.e. a plane parallel to the rotation plane of the gripper, preferably with adjustable spring force.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
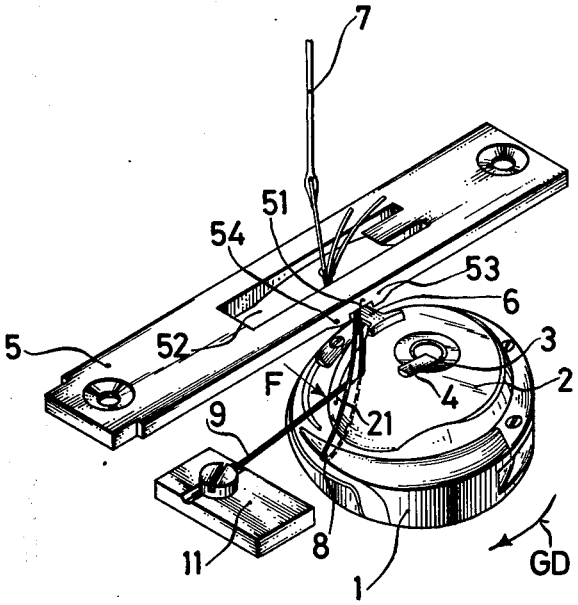
FIG. 1 is a diagrammatic perspective view of a bobbin and gripper assembly according to the present invention.

In FIG. 1 there is shown a gripper 1 which is driven in a horizontal plane by a vertical shaft (not shown) which is rotated by the arm shaft of the sewing machine which drives the double-lock-stitch gripper in the usual manner. The drive for the gripper and the gripper construction itself are conventional. As is also conventional in the art, the gripper surrounds and receives the bobbin housing 2 which is formed in two parts, only the upper part being visible in the drawing. The lower part is, in accordance with conventional teachings, provided on its periphery with a bearing rib guided in a channel within the gripper 1 and carrying a central pin 3 which receives the upper portion of the bobbin housing 2. A latch 4 releasably mounts the upper portion of the bobbin housing upon this pin 3.

The upper part of the bobbin housing 2 surrounds the bobbing which is rotatable on the pin 3 and has not been illustrated. The bobbin pays out the lower thread of the double-lock-stitch seam and, in accordance with conventional double-lock-stitch formation, the upper or needle thread 8 is engaged by the gripper and forms a loop around the lower thread which is supplied by the bobbin. The loop of the upper thread (needle thread) is shown in FIG. 1 in the phase of thread withdrawal, i.e. the phase just subsequent to maximum extension of the loop.

The bobbin housing 2 is provided with a retaining finger 5 which extends into a recess 51 of a stitch plate 5, the recess having a triangular section which forms the abutments 53 and 54 for the retaining finger 6.

The gripper 1 whose sense of rotation is represented by the arrow GD, tends to rotate the bobbin housing 2 in the same direction through bearing friction upon the periphery of the bobbin housing. The retaining finger 6 thus functions to prevent this rotation of the bobbin housing, i.e. the retaining finger 6 normally rests against the abutment 53. The abutment 54 is unimportant for the retaining function and can be eliminated altogether since the gripper 1 customarily rotates only in the direction of arrow GD. Abutment 54 is nevertheless provided to limit displacement in the opposite sense under the effect of the spring means or inertia according to the present invention.

The stitch plate 5 is formed with openings 52 for the usual fabric-transport teeth, not shown.

The construction of the gripper 1, the bobbin housing device with its retaining finger 6 and abutment 53, as far as has been described above, are conventional in the art and hence the structure involved has been illustrated only schematically.

According to the invention, however, in the direction of the thread withdrawal, i.e. the direction in which needle thread 6 is withdrawn, ahead of the retaining finger 6, there is provided a spring member which, in the embodiment illustrated in FIG. 1, is a resilient rod or wire 9. The spring 9 is engaged at one end in a holder 11 fixed with respect to the machine housing so that a free end of the spring wire 9 rests yieldably against a flank of a recess 21 formed in the upper part of the bobbin housing 2 so that the strain bears in the direction F against the bobbin housing, i.e. in a sense opposite that represented by the arrow GD. The spring wire 9 may be deflected away from the surface 21 by the withdrawal of the needle thread.

The spring wire 9 thus bears against the bobbing housing 2 to apply a torque to the latter in the sense opposite the sense represented by air GD. The spring force of the spring 9 is dimensioned to prevent the retaining finger 6 from resting against the abutment 53 in the position shown in FIG. 1 and to yieldably maintain a position in which the retaining finger 6 lies between the two abutments 53 and 54. As a result, a thread passage or gap is formed between the retaining finger 6 and the abutment 53 as is desirable when the loop formed by the rising movement of the needle 7 is engaged by the gripper 1.

The loop is thus drawn out as shown at 8 and swung around the bobbin housing 2 by the gripper so that when this loop approaches the rod 9, it bends the latter away from the flank 21 briefly and permits the retaining finger 6 to come to rest against the abutment 53, whereupon the loop clears the retaining device and the spring 9 again brings the retaining finger 6 into its intermediate position between the abutments 53 and 54.

The retaining device illustrated in FIG. 1 is effective at normal needle thread tensions and is relatively inexpensive. It has been found to be highly reliable.

Figure 2:
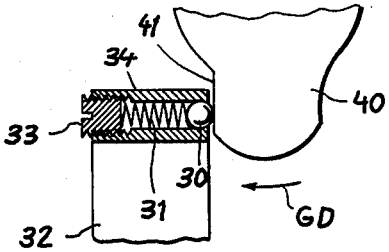
FIG. 2 is a plan view illustrating another embodiment of the spring body bearing upon the bobbin housing.

A similarly functioning device is illustrated in FIG. 2 where only the top of the bobbin 40 has been shown. In this case, the flank 41, equivalent to the flank 21, is engaged by a ball 30 received in a tubular housing 31 connected at 32 to a support structure similar to that shown at 11. A screw 33 threaded into the tube 34 compresses the spring 31 to apply the desired spring pressure to the bobbin 40. The needle thread loop 8 can pass between the flank 41 and the ball 30 as previously described. Advantageously, the ball rests against the bobbin housing with only point contact.

What is claimed is:

1. A bobbin and gripper assembly for a double-lock-stitch sewing machine which comprises:

a horizontal stitch plate traversed by the sewing machine needle and adapted to carry a needle thread through said stitch plate;

a gripper rotatably mounted below said stitch plate for rotation in a horizontal plane for engagement with said needle thread to form a loop and engage said loop with a lower thread;

a bobbin housing received in said gripper and rotatable relatively thereto, said bobbin housing receiving a bobbin for feeding said lower thread; and retaining means for restricting rotation of said bobbin housing relative to said gripper said retaining means including:

a retaining finger formed on said bobbin housing, an abutment formed on the underside of said stitch plate and engagable by said retaining finger upon angular entrainment of said bobbin housing with said gripper, and a spring bearing upon said bobbin housing in a sense opposite its sense of entrainment by said gripper and disposed in the path of a thread loop upon its disengagement from said gripper, said spring engaging said bobbin housing at a location ahead of and spaced from said retaining finger in the sense of rotation of said gripper.

2. The assembly defined in claim 1 wherein said spring is a spring rod fixed at one end remote from said bobbin housing and engaging said bobbin housing at its other end.

3. The assembly defined in claim 2 wherein said bobbin housing is formed with a recess having a flank engaged by said other end of said rod, said rod being deflected by said loop.

4. The assembly defined in claim 1 wherein said spring includes a ball bearing upon said bobbin housing and a compression spring urging said ball against said bobbin housing.

5. The assembly defined in claim 4, further comprising means for adjusting the spring force with which said ball bears upon said bobbin housing.

6. The assembly defined in claim 1 wherein the underside of said stitch plate is formed with a second abutment spaced from said first abutment, said spring being dimensioned to hold said finger substantially midway between said abutments.

* * * * *